US010683462B2

(12) United States Patent
Hjelmberg

(10) Patent No.: US 10,683,462 B2
(45) Date of Patent: Jun. 16, 2020

(54) AVIATION GASOLINE COMPOSITION, ITS PREPARATION AND USE

(71) Applicants: Hjelmco AB, Sollentuna (SE); TOTAL Marketing Services, Paris (FR); BP Oil International Limited, Middlesex (GB)

(72) Inventor: Lars Hjelmberg, Sollentuna (SE)

(73) Assignees: Hjelmco AB, Sollentuna (SE); TOTAL Marketing Services, Paris (FR); BP Oil International Limited, Middlesex (GB)

( * ) Notice: Subject to any disclaimer, the term of this patent is extended or adjusted under 35 U.S.C. 154(b) by 0 days.

(21) Appl. No.: 16/521,818

(22) Filed: Jul. 25, 2019

(65) Prior Publication Data

US 2019/0345401 A1 Nov. 14, 2019

Related U.S. Application Data

(63) Continuation of application No. 15/321,461, filed as application No. PCT/EP2015/064602 on Jun. 26, 2015, now Pat. No. 10,385,284.

(30) Foreign Application Priority Data

Jun. 27, 2014 (EP) ..... 14174862

(51) Int. Cl.

| | |
|---|---|
| ***C10L 1/04*** | (2006.01) |
| ***C10L 1/18*** | (2006.01) |
| ***C10L 10/10*** | (2006.01) |
| ***C10L 1/02*** | (2006.01) |
| ***C10L 1/06*** | (2006.01) |
| *C10L 1/185* | (2006.01) |
| *C10L 1/30* | (2006.01) |

(52) U.S. Cl.

CPC ..... *C10L 1/04* (2013.01); *C10L 1/023* (2013.01); *C10L 1/06* (2013.01); *C10L 1/18* (2013.01); *C10L 10/10* (2013.01); *C10L 1/1852* (2013.01); *C10L 1/305* (2013.01); *C10L 2200/0407* (2013.01); *C10L 2200/0423* (2013.01); *C10L 2270/023* (2013.01); *C10L 2270/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,451,075 | B1 | 9/2002 | Schoppe et al. | |
| 8,628,594 | B1 | 1/2014 | Braly | |
| 2002/0045785 | A1* | 4/2002 | Bazzani | C10L 1/023 585/14 |
| 2004/0124122 | A1* | 7/2004 | Clark | C10L 1/06 208/15 |
| 2013/0111805 | A1 | 5/2013 | Mathur et al. | |
| 2014/0116367 | A1 | 5/2014 | Braly | |
| 2016/0010018 | A1* | 1/2016 | D'Acosta | C10L 10/10 44/426 |

FOREIGN PATENT DOCUMENTS

WO WO-0240620 A2 5/2002

OTHER PUBLICATIONS

Greß, Tobias, "International Search Report," prepared for PCT/EP2015/064602, dated Sep. 4, 2015, four pages.
"Alkylation of Alkenes"; https://web.archive.org/web/20120205210017/http://www.organicchemistry.com/alkylation-of-alkenes/; Feb. 5, 2012; 6 pages.
Di Girolamo, Marco, et al., "Octane Enhancers," in Ullmann's Encyclopedia of Industrial Chemistry, Oct. 15, 2009, pp. 101-119.

* cited by examiner

*Primary Examiner* — Ellen M McAvoy
*Assistant Examiner* — Chantel L Graham
(74) *Attorney, Agent, or Firm* — Winstead PC

(57) ABSTRACT

An aviation gasoline composition comprising an impure iso-octane fraction, at least one xylene and at least one $C_4$ or $C_5$ alkane, wherein the impure iso-octane fraction in said composition is a fraction comprising at least 90 mol % iso-octane and having a final boiling point of at least 180° C. and is present in the composition in an amount in the range of from 30 to 80 vol. % based on the composition, the composition is substantially free of any lead compounds, the composition has a motor octane number of at least 94 and the composition has a final boiling point of at most 170° C. The composition of the present invention may be made by blending together an impure iso-octane fraction, xylene, at least one $C_4$ or $C_5$ alkane, optionally ethyl tertiary butyl ether, and optionally methylcyclopentadienyl manganese tricarbonyl and may be used in a spark ignition aviation engine, either alone or in combination with methanol or a methanol and water mixture.

50 Claims, No Drawings

AVIATION GASOLINE COMPOSITION, ITS PREPARATION AND USE

The present invention relates in general to a fuel composition and in particular to an aviation gasoline (Avgas).

International Patent Publication WO 02/40620 relates to an aviation gasoline fuel composition possessing a high motor octane number and which contains reduced amounts of tetraethyl lead compound. The Avgas composition is said to preferably contain about 20 to about 80 vol % iso-octane, about 5 to about 18 vol % toluene, about 1 to about 20 vol % $C_4$ to $C_5$ paraffins, about 0 to about 1 ml/gallon tetraethyl lead (TEL) and the balance light alkylate. The motor octane number (MON) is said to be preferably greater than or equal to about 100. The fuel is said to be preferably suitable as a substitute for Grade 100 LL aviation fuel. This patent publication illustrates only compositions with 0.9 ml/gallon tetraethyl lead.

US patent application US 2013/111805 discloses a high octane non-leaded gasoline meeting ASTM D910 LL standard is provided that includes a base gasoline fuel having a minimum MON of 96.5 and meeting the ASTM D910 standard. An octane-boosting component is mixed with the base gasoline fuel that raises the MON above 99.6 and the blended fuel complies with ASTM D910. The octane-boosting component is selected from a group including an additive, TEL only and a TEL containing gasoline.

U.S. Pat. No. 8,628,594 discloses an unleaded aviation fuel blend. The fuel blend is provided by blending an unleaded aviation gasoline base fuel which may include iso-octane and iso-pentane, and an effective amount of a selected alkyl benzene to improve the functional engine performance to avoid harmful detonation sufficient to meet or exceed selected standards for detonation performance requirements in full scale aircraft piston spark ignition engines designed for use with Grade 100 LL avgas. Advantageous alkylated benzenes include those having a meta-ring position between alkyl groups. Alkyl groups may be provided at least in part by methyl groups. In an embodiment, the alkyl benzene may include 1,3-dimethylbenzene. In an embodiment, two or more alkylated benzenes may be provided. In an embodiment, 1,3,5-trimethylbenzene may be provided. Suitable alkylated benzenes may include a mixture of xylene isomers. Selected aromatic amines, such as m-toluidine, may also be added to increase motor octane number.

US patent application US 2014/116367 discloses unleaded aviation gasoline. An aviation gasoline fuel blend includes an unleaded aviation gasoline base fuel, with an effective amount of selected alkyl benzenes to improve the functional engine performance to avoid harmful detonation sufficient to meet or exceed selected standards for detonation performance requirements in full scale aircraft piston spark ignition engines designed for use with Grade 100 LL avgas. Selected alkyl benzenes such as 1,3-dimethylbenzene, and/or 1,3,5-trimethylbenzene, or other mixtures thereof, may be used. Suitable alkylated benzenes may include a mixture of xylene isomers. Aromatic amines, such as m-toluidine, may also be added to increase MON. Base fuels may be a high quality aviation alkylate, or may be a commercial iso-octane, or a mixture of high quality aviation alkylate enhanced by commercial iso-octane, and may include iso-pentane or butane or both iso-pentane and butane in sufficient quantity to provide appropriate vapor pressure for the final fuel blend.

There is a current desire to remove lead compounds from aviation gasoline whilst still maintaining the high motor octane number (MON) expected in an aviation gasoline. Thus, there is a need for an aviation fuel that is substantially free of lead compounds which can be used in engines which presently use leaded aviation gasoline with a MON of at least 94, in particular high performance engines, such as those that presently use leaded aviation gasoline with a MON of at least 99.6 MON as well as such high performance engines which have been modified to use lower octane number fuels.

In order to enable the use of aviation gasoline compositions that are substantially free of lead compounds, other properties besides the MON of the aviation gasoline composition have to be considered. For example, the upper limit for the final boiling point of aviation gasoline compositions is limited by various aviation gasoline standards, and as such may limit the final boiling point of fuel components that may be used in the aviation gasoline.

Thus, according to the present invention there is provided an aviation gasoline composition comprising an impure iso-octane fraction, at least one xylene and at least one $C_4$ or $C_5$ alkane, wherein the impure iso-octane fraction in said composition is a fraction comprising at least 90 mol % iso-octane and having a final boiling point of at least 180° C. and is present in the composition in an amount in the range of from 30 to 80 vol. % based on the composition, the composition is substantially free of any lead compounds, the composition has a motor octane number of at least 94 and the composition has a final boiling point of at most 170° C.

The composition of the present invention solves the technical problem defined above by the use of the combination of an impure iso-octane fraction with xylene. The impure iso-octane fraction used in the present invention is an impure iso-octane fraction that has a final boiling point that is higher than would be generally considered for use in aviation gasoline compositions, however, it has been found that the combination of such an impure iso-octane fraction with xylene has a final boiling point which, surprisingly, is lower than the final boiling point of the impure iso-octane fraction alone. The aviation gasoline composition provided in the present invention also provides, in the substantial absence of lead compounds, a fuel with a MON of at least 94.

The composition of the present invention can provide similar performance in full size spark ignition aviation engines to leaded 91 MON aviation gasoline and in addition, leaded 99.6 MON aviation gasoline with suitable additional additives detailed below. This is advantageously linked with the volatility range achieved by the combination of impure iso-octane and xylene to give a product with a maximum final boiling point of 170° C. As such, the formulation offers a high octane quality aviation gasoline which will readily vapourise in the engine for cold start and distribute between the cylinders for correct operation, leaving no gum deposits or excessively diluting the engine oil.

The motor octane number (MON) is defined according to ASTM D2700 standard, which is known in the art.

The composition of the present invention preferably has a MON of at least 95 and more preferably of at least 96, and still more preferably of at least 98.

By substantially free of lead compounds is meant that the amount of lead compounds in the composition according to the present invention is not greater than 0.010 g of lead per litre, preferably not greater than 0.003 g of lead per litre. Lead compounds in particular which should be absent include tetraethyl lead. In particular, in the embodiments of the present invention described herein, no lead compounds are required to be added to the aviation gasoline composition; however, should the facilities used to produce and transport the aviation gasoline have previously been used for leaded aviation gasoline, some lead compounds may be present in the resultant aviation gasoline composition. Therefore, in some embodiments of the present invention, there is no detectable lead compounds in the aviation gasoline composition.

By "impure iso-octane fraction" is meant a fraction that is not 100% pure iso-octane. In one embodiment of the present invention, the impure iso-octane fraction comprises at least 90 mol % iso-octane, such as in the range of from 90 to 98 mol %. In another embodiment of the present invention, the impure iso-octane fraction may comprise up to 98 vol. % iso-octane. In specific embodiments, the impure iso-octane fraction comprises iso-octane in an amount in the range of from 90 vol. % to 98 vol. % and additionally contains at least one other iso-alkane having between 6 and 12 carbon atoms. In specific embodiments, the impure iso-octane fraction comprises iso-octane in an amount in the range of from 90 vol. % to 98 vol. % and additionally contains at least one other iso-alkene having between 8 and 12 carbon atoms. In other specific embodiments, the impure iso-octane fraction comprises at least 85 wt. % iso-octane. In other specific embodiments, the impure iso-octane fraction comprises iso-octane in an amount in the range of from 85 wt. % to 98 wt. %.

The impure iso-octane fraction may be prepared by any process known in the art. For example, the impure iso-octane composition may be prepared by fractionation of an alkylate stream obtained from an alkylation unit such as those commonly used in petroleum refineries. For example, by combination of impure iso-butane with impure iso-butane in the presence of sulphuric or hydrofluoric acid.

Iso-octane may also be produced by a process such as that described in WO 02/40620. In particular, the impure iso-octane fraction may also be obtained by the hydrogenation of di-isobutylene, which in turn may be prepared by the dimerisation of iso-butenes. Such dimerisation may be performed using converted Methyl Tertiary Butyl Ether (MTBE) production facilities. The iso-butene precursor for the preparation of iso-octane maybe prepared from the isomerisation of n-butane, for instance, using the Butamer process, commonly employed in the petroleum industry, followed by isobutane dehydrogenation.

Conveniently, by use of an impure iso-octane fraction, aviation gasoline compositions meeting the required MON specifications may be obtained in amore cost and/or energy efficient manner due to the reduction in required purification of the streams produced in the processes which are used to manufacture iso-octane. The final boiling point for the impure iso-octane fraction, as measured by test method ASTM D86, is at least 180° C., for example, the final boiling point of the impure iso-octane fraction may be in the range of from 180 to 200° C., for example 184° C. The initial boiling point may range from 25° C. to 99° C., for example 86° C.

It has been surprisingly found that the combination of xylene with the impure iso-octane suppresses the final boiling point of the iso-octane fraction such that it is possible to produce an aviation gasoline composition having a final boiling point which is at most 170° C., preferably a final boiling point of below 170° C. To achieve the desired effect xylene may be present in an amount of up to 30 vol. % of the aviation gasoline composition of the present invention, preferably up to 25 vol. %, more preferably up to 20 vol. %, even more preferably up to 15 vol. %; preferably the xylene is present in an amount of at least 0.5 vol. %, more preferably at least 1 vol. %, more preferably at least 2 vol. %, even more preferably at least 5 vol. %. Suitably, to achieve the desired effect xylene may be present in an amount in the range of from 0.5 to 30 vol. % (0.5% to 30% volume fraction), more preferably in the range of from 1 to 25 vol. % (1% to 25% volume fraction), even more preferably in the range of from 2 to 20 vol. % (2% to 20% volume fraction) and still more preferably in the range of from 5 to 15 vol. % (5% to 15% volume fraction). By the term 'xylene' it is meant any one or more xylene selected from orth-xylene, para-xylene and meta-xylene, and wherein the volume fraction of the xylene is the total volume fraction of all isomers of xylene. In specific embodiments, the xylene may be present in the form of meta-xylene.

The impure iso-octane may be present in an amount in the range of from 30 to 80 vol. % (30 to 80% volume fraction), preferably, the aviation gasoline composition of the present invention comprises at least 40 vol. %, more preferably at least 50 vol. % of the impure iso-octane fraction; preferably, the impure iso-octane fraction will present in an amount in the range of from 40 to 70 vol. % (40 to 70% volume fraction), more preferably in the range of from 50 to 60 vol. % (50 to 60% volume fraction) of the aviation gasoline composition of the present invention.

The amount of the at least one $C_4$ or $C_5$ alkane included in the aviation gasoline composition of the present invention is such that the finished fuel meets the specification to which it is being blended in terms of vapour pressure and distillation characteristics. The $C_4$ alkane includes, amongst others, n-butane and iso-butane isomers. Thus, in some specific embodiments, the aviation gasoline composition comprises both n-butane and iso-butane. Preferably the $C_4$ alkane is present in the aviation gasoline composition of the present invention in an amount in the range of from 0.1 to 4 vol. % (0.1 to 4% volume fraction), more preferably in an amount in the range of from 0.5 to 2 vol. % (0.5 to 2% volume fraction) and still more preferably in an amount in the range of from 0.5 to 1 vol. % (0.5 to 1% volume fraction).

Preferably, the at least one $C_4$ or $C_5$ alkane used in the aviation gasoline composition of the present invention is iso-pentane. The iso-pentane used in the composition of the present invention may be provided as a substantially pure component and/or as a component in a $C_5$ refinery stream, for example from an isomerisation unit. The iso-pentane present in the aviation gasoline composition of the present invention is preferably in an amount in the range of from 5 to 30 vol. % (5 to 30% volume fraction), more preferably in the range of from 10 to 25 vol. % (10 to 25% volume fraction), and still more preferably in the range of from 10 to 20 vol. % (10 to 20% volume fraction).

In specific embodiments of the present invention, the aviation gasoline composition additionally comprises methylcyclopentadienyl manganese tricarbonyl (MMT). The addition of MMT can advantageously increase the MON of the composition without having a significant effect on the distillation characteristics of the composition. Preferably, in the embodiments wherein MMT is present in the aviation gasoline composition, the MMT is present in the composition an amount in the range of from 1 mgMn/l to 250 mgMn/l, preferably in the range of from 10 mgMn/l to 200 mgMn/l, more preferably in the range of from 20 mgMn/l to 100 mgMn/l.

In specific embodiments of the present invention, the aviation gasoline composition additionally comprises ethyl tertiary butyl ether (ETBE). The addition of ETBE can advantageously increase the MON of the composition without increasing the final boiling point of the composition.

Furthermore, the addition of ETBE can also increase the vapor pressure, as well as the MON of the composition, thereby advantageously reducing the need for high amounts of iso-pentane. Iso-pentane may be used to increase the vapor pressure of the composition but may give rise to a reduction in MON value. Preferably, in the embodiments wherein ETBE is present in the aviation gasoline composition, the ETBE is present in an amount in the range of from 1 vol. % to 50 vol. % based on the composition, more preferably in the range of from 5 vol. % to 35 vol. % based on the composition.

In specific embodiments of the present invention, the aviation gasoline composition additionally comprises both MMT and ETBE.

In the embodiments wherein ETBE and/or MMT are present in the aviation gasoline composition, the MON of such compositions will preferably be at least 98 and more preferably of at least 99.

In a further embodiment of the invention, methanol and water, either individually or preferably in combination, may be combined with the aviation gasoline composition according to the present invention; when both methanol and water are present, the volume ratios of methanol : water may suitably be in the range of from 1:2 to 2:1, such as ratios of 1:1, 2:1, or 1:2. The methanol and water are preferably not combined with the formulation in a storage tank, for example a refinery manufacturing tank, but are preferably combined with the aviation gasoline composition according to the present invention at point of delivery into the engine induction system. For example, the methanol and water may be injected into the engine air or fuel mixture intake manifold. The combination of the aviation gasoline composition according to the present invention with the water and methanol may further enhance the performance of the fuel in the spark ignition engine.

The composition of the present invention may comprise a dye, or may be undyed. The composition of the present invention may comprise one or more anti-oxidants such as hindered phenols.

The composition of the present invention may comprise one or more lubricity improvers such as acids, esters and/or amides. Biofuel may also be present in the composition of the present invention. The biofuel may be formed by combination of a renewable alcohol, for example ethanol fermented from corn or similar feed-stock, with $C_4$ hydrocarbons to form ETBE. Alternatively, the biofuel may be formed by fermentation of other feed-stocks to give methanol for use in combination with the invention at point of delivery to the engine. The composition of the present invention may comprise one or more conductivity improvers such as nitrogen and/or sulphur containing polymeric compounds (for example, Stadis® 450). Preferably, in the embodiments wherein one or more conductivity improvers is present in the aviation gasoline composition, the one or more conductivity improvers is present in the composition in an amount up to 5.0 mg/l, more preferably in an amount up to 3.0 mg/l. The composition of the present invention may comprise one or more additives to reduce valve seat recession, such as phosphorus, potassium or sodium based valve seat recession additives.

The composition of the present invention may independently have one or more of the features listed in Table 1 below and preferably all of the features.

TABLE 1

| Feature | Range/value |
|---|---|
| Vapour pressure | 38 to 49 kPa |
| Distillation properties: | |
| 10% evaporation | by 75° C. max |
| 40% evaporation | by 75° C. min |
| 50% evaporation | by 105° C. max |
| 90% evaporation | by 135° C. max |
| Final boiling point | ≤170° C. |
| Recovery | 97% v/v min |
| Supercharge (D909) | Not specified, or >96 or >98 ON |
| Calorific value | 41.5 to 44.0 MJ/kg |
| Freezing point | Less than or equal to −58° C. |

Preferably, the composition of the present invention meets the Def Stan 91-90 standard and/or ASTM D910 standards with the provisos (i) that the MON value is at least 94, more preferably at least 96 and still more preferably at least 99, (ii) the supercharge is unspecified or at least 96 and (iii) the composition is substantially free of any lead compounds.

The composition of the present invention may be made by blending together an impure iso-octane fraction, xylene, at least one $C_4$ or $C_5$ alkane, optionally ethyl tertiary butyl ether, and optionally methylcyclopentadienyl manganese tricarbonyl. A mixture of methanol and water may be added to the formulation at point of delivery into the engine to further enhance performance. Preferably, the composition of the present invention is made by adding to the aviation gasoline or one or more of the components thereof, one or more aviation gasoline additives selected from the group consisting of dye, anti-oxidants, lubricity improvers, conductivity improvers and additives to reduce valve seat recession.

The composition of the present invention may further comprise at least one fuel system icing inhibitor. Such icing inhibitors are preferably added at the point of use of the composition. Suitable fuel system icing inhibitors comprise alcohols or ethers for example diethylene glycol monomethyl ether and iso-propanol. The icing inhibitor may be used in an amount of up to 5% by volume in the fuel composition. Advantageously, the icing inhibitor may be added in the form of water/methanol delivered directly into the induction system of the engine in combination with the invention.

The composition of the present invention may be used in spark ignition aviation engines. The aviation engines may be capable of operating at 30 metres or more above sea level. The aviation engines may be used to propel heavier than air craft such as light aircraft. The aviation engines may be used to propel lighter than air craft such as airships. Thus, according to a further embodiment of the present invention there is provided a method of operating a spark ignition aviation engine which comprises providing said engine with an aviation gasoline composition comprising an impure iso-octane fraction, at least one xylene and at least one $C_4$ or $C_5$ alkane, wherein the impure iso-octane fraction in said composition is a fraction comprising at least 90 mol % iso-octane and having a final boiling point of at least 180° C. and is present in the composition in an amount in the range of from 30 to 80 vol. % based on the composition, the composition is substantially free of any lead compounds, the composition has a motor octane number of at least 94 and the composition has a final boiling point of at most 170° C.

The present invention will now be illustrated by reference only to the following examples.

EXAMPLE 1

69% volume impure iso-octane fraction (having an iso-octane content of greater than 90 mol %) with a boiling point of greater than 180° C. was combined with 13% volume xylene and 18% volume iso-pentane to give an unleaded aviation gasoline of 96.0 MON, Table 2. Final boiling point was 168° C.

TABLE 2

| Analysis | Units | Specification | Result |
|---|---|---|---|
| Impure Iso-Octane | % v/v | | 69 |
| Xylene | | | 13 |
| Iso-pentane | | | 18 |
| Appearance | Visual | Clear | |
| MON | ON | | 96.0 |
| MON + 36 mgMn/l (MMT) | ON | | |
| Supercharge | PN | | |
| Supercharge + 36 mgMn/l (MMT) | PN | | |
| Lead Content | gPb/l | 0.013 max | |
| Density @ 15° C. | kg/m$^3$ | Report | 721.1 |
| Distillation | | | |
| Initial Boiling Point | ° C. | Report | 36.0 |
| 10% v/v at | ° C. | 75 max | 67.2 |
| 40% v/v at | ° C. | 75 min | 100.5 |
| 50% v/v at | ° C. | 105 max | 103.2 |
| 90% v/v at | ° C. | 135 max | 127.9 |
| Final boiling point | ° C. | 170 max | 168.1 |
| Sum T10% + T50% v/v | ° C. | 135 min | 170.4 |
| Recovery | % v/v | 97 min | |
| Residue | % v/v | 1.5 max | 1.0 |
| Loss | % v/v | 1.5 max | 0.7 |
| Vapor Pressure @ 38° C. | kPa | 38.0-49.0 | 38.2 |
| Freeze Point | ° C. | −58 min | <−80 |
| Sulfur Content | % m/m | 0.05 max | <0.0001 |
| Net Heat of Combustion | MJ/kg | 43.5 min | 43.761 |
| Copper Cu. 2 hrs @ 100° C. | Rating | No. 1 | 1a |
| Oxidation stability (5 hrs) | | | |
| Potential gum | mg/100 mL | 6 | <1.0 |
| Water Reaction | | | |
| Volume change | mL | +/−2 | 0 |
| Interface rating | visual | 2 max | 1 |
| Separation rating | visual | 1 max | 1 |
| Hydrogen content | — | % m/m | |

EXAMPLE 2

55% volume impure iso-octane fraction (having an iso-octane content of greater than 90 mol %) with a boiling point of greater than 180° C. was combined with 2% volume xylene, 30% volume ETBE and 13% volume iso-pentane to give an unleaded aviation gasoline of 97.2 MON, Table 3. Addition of 36 mgMn/l MMT additive further improved octane quality to 99.7 MON, >130 PN supercharge, the latter being measured by test method ASTM D909, Final boiling point was 163.5 to 166.5° C.

TABLE 3

| Analysis | Units | Specification | 97 UL | 100 UL |
|---|---|---|---|---|
| Industrial Iso-Octane 'Alkylate' | % v/v | | 55 | 55 |
| Xylene | | | 2 | 2 |
| ETBE | | | 30 | 30 |
| Iso-pentane | | | 13 | 13 |
| Appearance | Visual | Clear | | Clear |
| MON | ON | | 97.2 | |
| MON + 36 mgMn/l (MMT) | ON | | 99.7 | 99.7 |
| Supercharge | PN | | >130 | |
| Supercharge + 36 mgMn/l (MMT) | PN | | | >138.4 |
| Lead Content | gPb/l | 0.013 max | | 0.0 |
| Density @ 15° C. | kg/m$^3$ | Report | | 708.1 |
| Distillation | | | | |
| Initial Boiling Point | ° C. | Report | 42.0 | 44.5 |
| 10% v/v at | ° C. | 75 max | 68.5 | 70.0 |
| 40% v/v at | ° C. | 75 min | 83.5 | 84.5 |
| 50% v/v at | ° C. | 105 max | 87.5 | 88.5 |
| 90% v/v at | ° C. | 135 max | 104.0 | 105.5 |
| Final boiling point | ° C. | 170 max | 163.5 | 166.5 |
| Sum T10% + T50% v/v | ° C. | 135 min | 156.0 | 158.5 |
| Recovery | % v/v | 97 min | 98.0 | 98.5 |
| Residue | % v/v | 1.5 max | 1.3 | 1.2 |
| Loss | % v/v | 1.5 max | 0.7 | 0.3 |
| Vapor Pressure @ 38° C. | kPa | 38.0-49.0 | 41.2 | 39.8 |
| Freeze Point | ° C. | <58 min | | <−70 |
| Sulfur Content | % m/m | 0.05 max | | 0.0003 |
| Net Heat of Combustion | MJ/kg | 43.5 min | | 41.8 |
| Copper Cu. 2 hrs @ 100° C. | Rating | No. 1 | | 1a |
| Oxidation stability (5 hrs) | | | | |
| Potential gum | mg/100 | 6 | | 4 |
| Water Reaction | | | | |
| Volume change | mL | +/−2 | | 0 |
| Interface rating | visual | 2 max | | 1b |
| Separation rating | visual | 1 max | | 1 |
| Hydrogen content | — | % m/m | | 15.02 |

The invention claimed is:

1. A gasoline composition comprising:

an impure iso-octane fraction comprising at least 90 mol % iso-octane, wherein the impure iso-octane fraction has a final boiling point of at least 180° C., and wherein the impure iso-octane fraction is present in the composition in an amount in the range of from 30 to 80 vol. % based on the composition;

at least one xylene;

at least one $C_4$ or $C_5$ alkane;

wherein the composition is substantially free of any lead compounds, wherein the composition has a motor octane number of at least 94, and wherein a combination of the impure iso-octane fraction and the at least one xylene are present in an amount such that the composition has a final boiling point of at most 170° C.; and wherein the gasoline composition additionally comprises ethyl tertiary butyl ether (ETBE) in an amount in the range of from 5 vol. % to 35 vol. % based on the composition.

2. The composition as claimed in claim 1 in which the composition has a MON of at least 95.

3. The composition as claimed in claim 1 in which the composition has a MON of at least 96.

4. The composition as claimed in claim 1 in which the distillation of the composition has a T10 of at most 75° C., a T40 of at least 75° C., a T50 of at most 105° C., and a T90 of at most 135° C.

5. The composition according to claim 1 in which the impure iso-octane fraction is present in the composition in an amount in the range of from 40 vol. % to 70 vol. % based on the composition.

6. The composition according to claim 1 in which the at least one xylene is present in an amount in the range of from 0.5 vol. % to 30 vol. % based on the composition.

7. The composition according to claim 1 in which the at least one $C_4$ or $C_5$ alkane is an iso-pentane.

8. The composition according to claim 1 in which the xylene is meta-xylene or para-xylene.

9. The composition according to claim 1 in which the impure iso-octane fraction is obtained from the fractionation of an alkylate stream obtained from an alkylation unit.

10. The composition according to claim 9 in which the impure iso-octane fraction comprises iso-octane in an amount in the range of from 90 vol. % to 98 vol. % and additionally contains at least one other iso-alkane having between 6 and 12 carbon atoms.

11. The composition according to claim 1 in which the impure iso-octane fraction is obtained from the dimerization of iso-butylene compositions followed by hydrogenation of the dimerization product stream.

12. The composition according to claim 11 in which the impure iso-octane fraction comprises iso-octane in an amount in the range of from 90 vol. % to 98 vol. % and additionally contains at least one other iso-alkene having between 8 and 12 carbon atoms.

13. The composition according to claim 1 in which the gasoline composition additionally comprises methylcyclopentadienyl manganese tricarbonyl.

14. The composition according to claim 13 in which the methylcyclopentadienyl manganese tricarbonyl is present in the composition in an amount in the range of from 1 mgMn/l to 250 mgMn/l.

15. The composition according to claim 1 in which the composition has a MON of at least 98.

16. The composition as claimed in claim 1 in which methanol or a mixture of water and methanol, is combined with the gasoline composition at the point of delivery into an engine induction system.

17. The composition as claimed in claim 1 in which the composition comprises a dye.

18. The composition as claimed in claim 1 in which the composition comprises at least one anti-oxidants such as hindered phenols.

19. The composition as claimed in claim 18 in which the composition the at least one anti-oxidants is hindered phenols.

20. The composition as claimed in claim 1 in which the composition comprises at least one lubricity improvers such as acids, esters and/or amides.

21. The composition as claimed in claim 20 in which the at least one lubricity improvers is at least one of acids, esters, and amides.

22. The composition as claimed in claim 1 in which the composition comprises at least one conductivity improvers such as nitrogen and/or sulphur containing polymeric compounds.

23. The composition as claimed in claim 22 in which the at least one conductivity improvers is at least one of nitrogen and a sulphur containing polymeric compound.

24. The composition as claimed in claim 1 in which the composition comprises at least one biofuels.

25. The composition as claimed in claim 1 in which the composition comprises at least one additives to reduce valve seat recession, such as phosphorus, potassium or sodium based valve seat recession additives.

26. The composition as claimed in claim 25 in which the at least one additives to reduce valve seat recession is at least one of phosphorus, potassium, and a sodium based valve seat recession additive.

27. The composition according to claim 6 in which the at least one xylene is present in an amount in the range of from 1 vol. % to 25 vol. % based on the composition.

28. The composition according to claim 27 in which the at least one xylene is present in an amount in the range of from 2 vol. % to 20 vol. % based on the composition.

29. The composition according claim 1 in which the ethyl tertiary butyl ether is present in the composition in an amount of 30 vol. % based on the composition.

30. The composition according to claim 14 in which the methylcyclopentadienyl manganese tricarbonyl is present in the composition in an amount in the range of from 10 mgMn/l to 200 mgMn/l.

31. The composition according to claim 30 in which the methylcyclopentadienyl manganese tricarbonyl is present in the composition in an amount in the range of from 20 mgMn/l to 100 mgMn/l.

32. The composition according to claim 15 in which the composition has a MON of at least 99.

33. The composition according to claim 1 in which the composition comprises at least one fuel system icing inhibitor.

34. The composition according to claim 1 in which the at least one xylene is present in an amount in the range of up to 30 vol. % based on the composition.

35. The composition according to claim 1 in which the xylene is para-xylene.

36. The composition according to claim 1 in which an amount of lead in the composition is not greater than 0.010 g of lead per liter.

37. The composition according to claim 1 in which an amount of lead in the composition is not greater than 0.003 g of lead per liter.

38. The composition according to claim 24 in which the at least one biofuels is a biofuel formed by combination of ethanol fermented from corn or similar feed-stock with C4 hydrocarbons to form ETBE.

39. The composition according to claim 1 in which the composition comprises 55% volume of the impure iso-octane fraction based on the composition.

40. The composition according to claim 39 in which the composition in which the at least one xylene is present in an amount of 2 vol. % based on the composition.

41. The composition according to claim 13 in which the methylcyclopentadienyl manganese tricarbonyl is present in the composition in an amount in the range of from 20 mgMn/l to 100 mgMn/l and the ethyl tertiary butyl ether is present in the composition in an amount of 30 vol. % based on the composition.

42. The composition according to claim 39 in which the composition comprises 13 vol. % volume iso-pentane based on the composition.

43. The composition according to claim 39 in which methylcyclopentadienyl manganese tricarbonyl is present in the composition in an amount of 36 mgMn/l.

44. The composition according to claim 39 in which the composition in which the at least one xylene is present in an amount of 2 vol. %, the ethyl tertiary butyl ether is present in the composition in an amount of 30 vol. % and the composition comprises 13 vol. % volume iso-pentane based on the composition.

45. The composition according to claim 42 in which methylcyclopentadienyl manganese tricarbonyl is present in the composition in an amount of 36 mgMn/l.

46. The composition according to claim 39 in which the at least one xylene is present in an amount of 2 vol. %, the ethyl tertiary butyl ether is present in the composition in an amount of 30 vol. %, the composition comprises 13 vol. % volume iso-pentane based on the composition and methylcyclopentadienyl manganese tricarbonyl is present in the composition in an amount of 36 mgMn/l.

47. The composition according to claim 44 in which the composition has a final boiling point of 163.5 to 166.5° C.

48. The composition according to claim 1 in which the at least one xylene is present in an amount in the range of from 0.5 vol. % to 30 vol. % based on the composition and wherein the gasoline composition additionally comprises methylcyclopentadienyl manganese tricarbonyl (MMT).

49. A gasoline composition comprising:

an impure iso-octane fraction comprising at least 90 mol % iso-octane, wherein the impure iso-octane fraction has a final boiling point of at least 180° C., and wherein the impure iso-octane fraction is present in the composition in an amount in the range of from 30 to 80 vol. % based on the composition;

at least one xylene in an amount in the range of from 0.5 vol. % to 30 vol. % based on the composition;

at least one $C_4$ or $C_5$ alkane;

wherein, the composition is substantially free of any lead compounds, wherein the composition has a motor octane number of at least 94, and wherein a combination of the impure iso-octane fraction and the at least one xylene are present in an amount such that the composition has a final boiling point of at most 170° C.;

wherein the gasoline composition additionally comprises ethyl tertiary butyl ether (ETBE); and wherein the gasoline composition additionally comprises methylcyclopentadienyl manganese tricarbonyl.

50. The composition according to claim 49 in which the methylcyclopentadienyl manganese tricarbonyl is present in the composition in an amount in the range of from 20 mgMn/l to 100 mgMn/l and the ethyl tertiary butyl ether is present in the composition in an amount of 30 vol. % based on the composition.

* * * * *